United States Patent [19]

Geer et al.

[11] 4,003,614

[45] Jan. 18, 1977

[54] DRAWER HANDLE WITH LOCKING MECHANISM

[75] Inventors: Larry A. Geer, Upland; Ralph L. Sheffer, Arcadia, both of Calif.

[73] Assignee: Adams Rite Products, Inc., Glendale, Calif.

[22] Filed: June 12, 1975

[21] Appl. No.: 586,290

[52] U.S. Cl. ..... 312/320; 312/319; 292/240; 292/97

[51] Int. Cl.[2] ..... A47B 95/02; E05C 19/10

[58] Field of Search ..... 292/95, 97, 109, 110, 292/111, 113, 123, 240, 256.5, 336.3, 217, DIG. 49, DIG. 71, 196; 312/319, 320

[56] References Cited

UNITED STATES PATENTS

| | | | |
|---|---|---|---|
| 2,609,268 | 9/1952 | Nye | 312/320 |
| 2,716,262 | 8/1955 | Oswald | 292/240 X |
| 2,829,914 | 4/1958 | Peras | 292/217 |
| 2,944,864 | 7/1960 | Krivulka | 292/240 X |
| 3,190,713 | 6/1965 | Vander Sande et al. | 312/320 |
| 3,193,342 | 7/1965 | Sauter | 312/320 |
| 3,262,726 | 7/1966 | Phelps | 292/196 |
| 3,575,482 | 4/1971 | MacMaster et al. | 312/320 |
| 3,721,359 | 3/1973 | Howell et al. | 292/97 X |

FOREIGN PATENTS OR APPLICATIONS

| | | | |
|---|---|---|---|
| 337,792 | 3/1936 | Italy | 292/196 |

*Primary Examiner*—Paul R. Gilliam
*Assistant Examiner*—Victor N. Sakran
*Attorney, Agent, or Firm*—Whann & McManigal

[57] ABSTRACT

A drawer handle for use in the normal operation of opening and closing a cabinet mounted slide drawer, and which also includes manually operable components including a pivoted hook for engagement with a recessed keeper on the cabinet, and being operable in the final closing and initial opening movements of the drawer to apply an increased force over and above that required for normally moving the drawer in its open and partially open positions.

13 Claims, 6 Drawing Figures

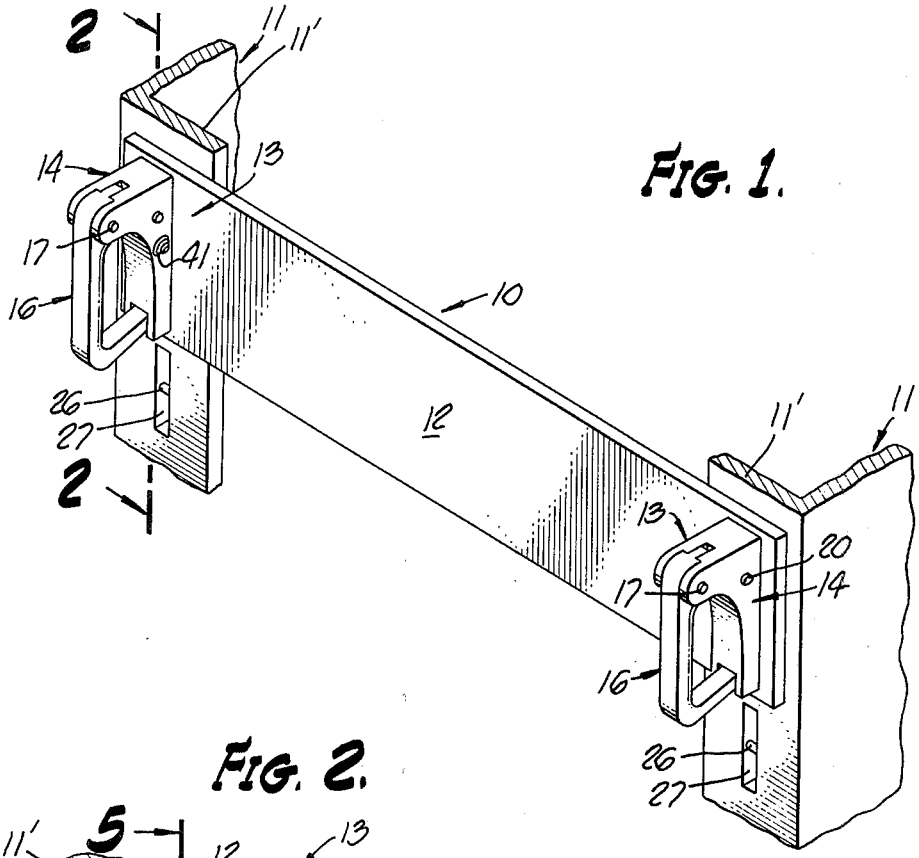
FIG. 1.
FIG. 2.
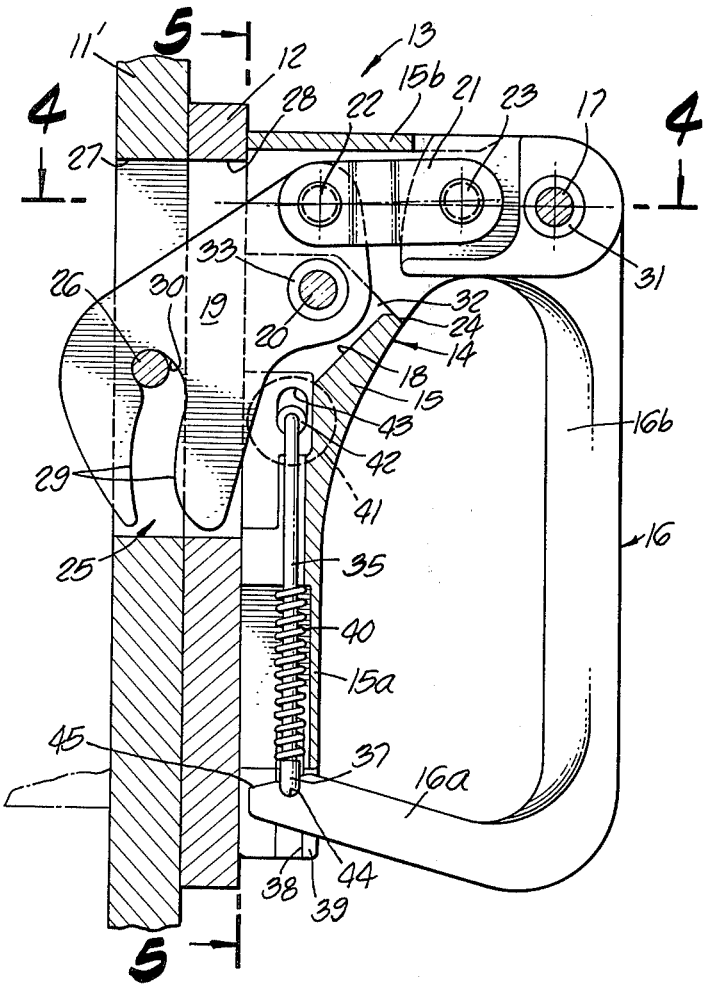
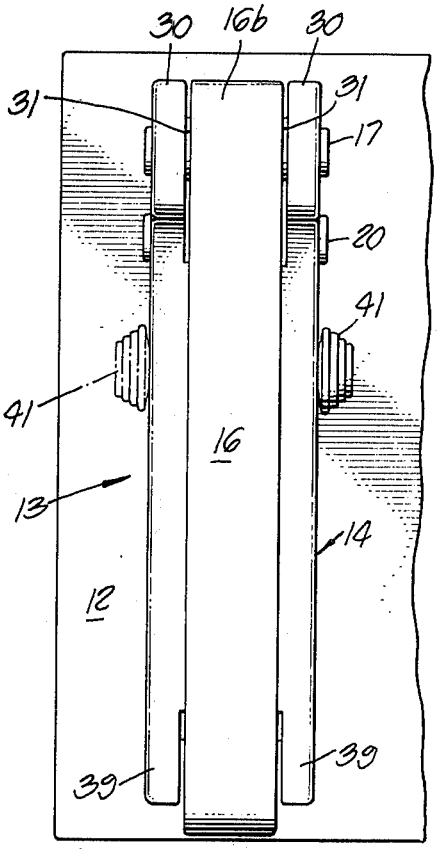
FIG. 3.

DRAWER HANDLE WITH LOCKING MECHANISM

BACKGROUND OF THE INVENTION

The present invention relates generally to drawer handles.

An important problem arises in the case of conventional slide mounted cabinet drawers, where the drawers are utilized for the mounting of electronic and other electric components to facilitate checking, maintenance, repair, replacement, and for other reasons.

In such installations, it is the usual custom to provide at the back of the drawer, a plurality of electric plug connectors which will be engaged during the final closing movement of the drawer, and disengaged during the initial opening movement of the drawer. It will be appreciated that this engagement and disengagement of the plug connectors requires the application of increased forces over and above that normally required to slidably move the drawer in its opened or partially opened positions. Additional means are therefore desirably necessary to mechanically produce these increased forces in a practial and economic manner, and which will also function to effectively and releasably lock and apply a holding load force to the drawer in its fully closed position.

To overcome the disadvantages inherent to conventional slide drawers for the foregoing purpose, the present invention provides a drawer handle which is operable in the usual manner for opening and closing the drawer. This handle is further arranged to be swingably mounted and connected with a swingably mounted hook which is movable between locking and non-locking positions in response to relative movements of the handle. The hook is provided with an end opening slot adapted in the non-locking position of the hook to receive a cabinet mounted recessed keeper thereinto as the drawer approaches a fully closed position, and in which position the plug connectors are beginning their engagement. The actuator handle may at this time be swung in a direction to move the hook towards its locking position, whereupon the keeper is moved further into the slot to a position in which a camming surface is effective to apply increased forces to the drawer for completing its movement to a fully closed position in which the plug connectors will be fully connected. The camming surface of the hook is also operative to apply increased forces during the initial opening movement of the drawer from its fully closed position during which time the plug connectors will be disconnected. It has been found by test that a drawer equipped with two of the handles embodying the features of the present invention will operate to produce increased forces of the order of 300 lbs. to move the drawer a distance of approximately 0.50 inch.

A further important vital problem arises when it is attempted to use cabinet drawer mounting arrangements of conventional construction for the mounting of electronic and other sensitive equipment in cabinet locations, such as on shipboard, where they may be subjected to environmental vibrations and shock forces of undesirable proportions which will tend to move the slidable drawers within the cabinet in a manner which could damage or affect the operation of the equipment therein.

In installations as just described, these shock loads may conceivably be as high or greater than 5000 lbs. In order to withstand these high shock loads in the closed position of the drawer, the innermost end terminus of the hook slot is conformed so as to increase the contact area between the keeper and the associated slot edge, when the hook is in locked position.

It has also been found desirable to apply a loading force between the keeper and the hook, in the closed position of the drawer. This is accomplished by utilizing a connecting link between the hook and the hook actuating handle, this link being so connected as to be capable of passing through an over-center position, after the hook has reached a stop locked position against the associated keeper.

SUMMARY OF THE INVENTION

The present invention relates generally to a drawer handle structure, and is more particularly directed to a handle structure in which the parts are cooperatively associated and operable in conjunction with a keeper to mechanically amplify manually applied forces, and utilize these amplified forces for moving the drawer as it approaches and leaves its fully closed position, and for forceably holding the drawer in a fully closed position.

It is one object of the herein described invention to provide an improved drawer handle combination which is operable to lock and maintain a sliding drawer in closed position under high shock and vibrational force conditions.

A further object is to provide an improved manually operable drawer handle construction having locking mechanism operative to apply final closing and initial opening forces of increased magnitude to the drawer.

A still further object resides in the provision of an improved drawer moving handle structure which embodies a manually swingable hook member arranged for coacting with a fixed keeper in a manner to apply increased drawer moving forces during final closing and initial opening movements of the drawer.

Another object is to provide a drawer moving handle structure according to the previous object, and in which manually operable handle means actuates the hook in a manner to apply a load force for holding the drawer in a closed position in opposition to high shock forces tending to open the drawer.

Still another object according to the present invention is to provide a drawer moving handle structure having a manually swingable handle for moving a hook member between a locking position and non-locking position, the hook member having an open-ended slot for receiving a fixed keeper therein and providing camming means for effecting increased drawer closing forces; and in which the handle is connected to the hook through linkage means capable of assuming an over-center latching position in the locked position of the hook; and which further includes releasable latch means for retaining the swingable handle in its position corresponding to the locked position of the hook.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 1 is a fragmentary perspective view of a cabinet mounted drawer with a pair of drawer actuating handles embodying the features of the present invention;

FIG. 2 is an enlarged side elevational view of the drawer handle with a portion in section being taken substantially on line 2—2 of FIG. 1, the parts being shown in locked position;

FIG. 3 is a front elevational view of the handle structure as it appears in FIG. 2;

DESCRIPTION OF A PREFERRED EMBODIMENT

Referring now specifically to the drawings, for illustrative purposes, a drawer handle for cabinet mounted slide drawers, which embodies the features of the present invention, is disclosed in FIG. 1, wherein a sliding drawer, as generally indicated by the numberal 10, is operatively mounted for sliding movements in an associated upstanding cabinet structure, as generally indicated by the cabinet sides 11. The drawer structure and cabinet structure may vary with respect to specific design configuration and structural details. In the present instance, the drawer is shown as including a front upstanding panel 12 which is adapted in closed position of the drawer to engage cabinet side flanges 11′, 11′.

As further shown in FIG. 1, the front panel 12 has end portions which overlie the front surfaces of the side flanges 11′, and are adapted to bear against these front surfaces, when the drawer is in fully closed position. A pair of drawer handle assemblies, as generally indicated at 13, are respectively mounted on the forward faces of the panel end portions, these handle assemblies providing manual actuators for moving the drawer during its usual sliding movements, and further providing means for applying increased drawer moving forces as the drawer approaches fully closed position, and as it is initially moved in an opening direction from the fully closed position, as will hereinafter be explained more fully.

The last mentioned function of the drawer handle assemblies is of particular advantage in those instances in which the cabinet mounted drawers are utilized for the mounting of electronic and other electrical equipment which necessitate the utilization of electric plug connectors mounted at the rear of the drawer for engagement with mating receptacles mounted in the cabinet. In these installations, the application of increased drawer moving forces over and above the force that is normally required for normal drawer movements, are particularly advantageous. The means for mechanically multiplying the manually applied forces on the handle assembly constitutes an important feature of the present invention.

Figure 6:
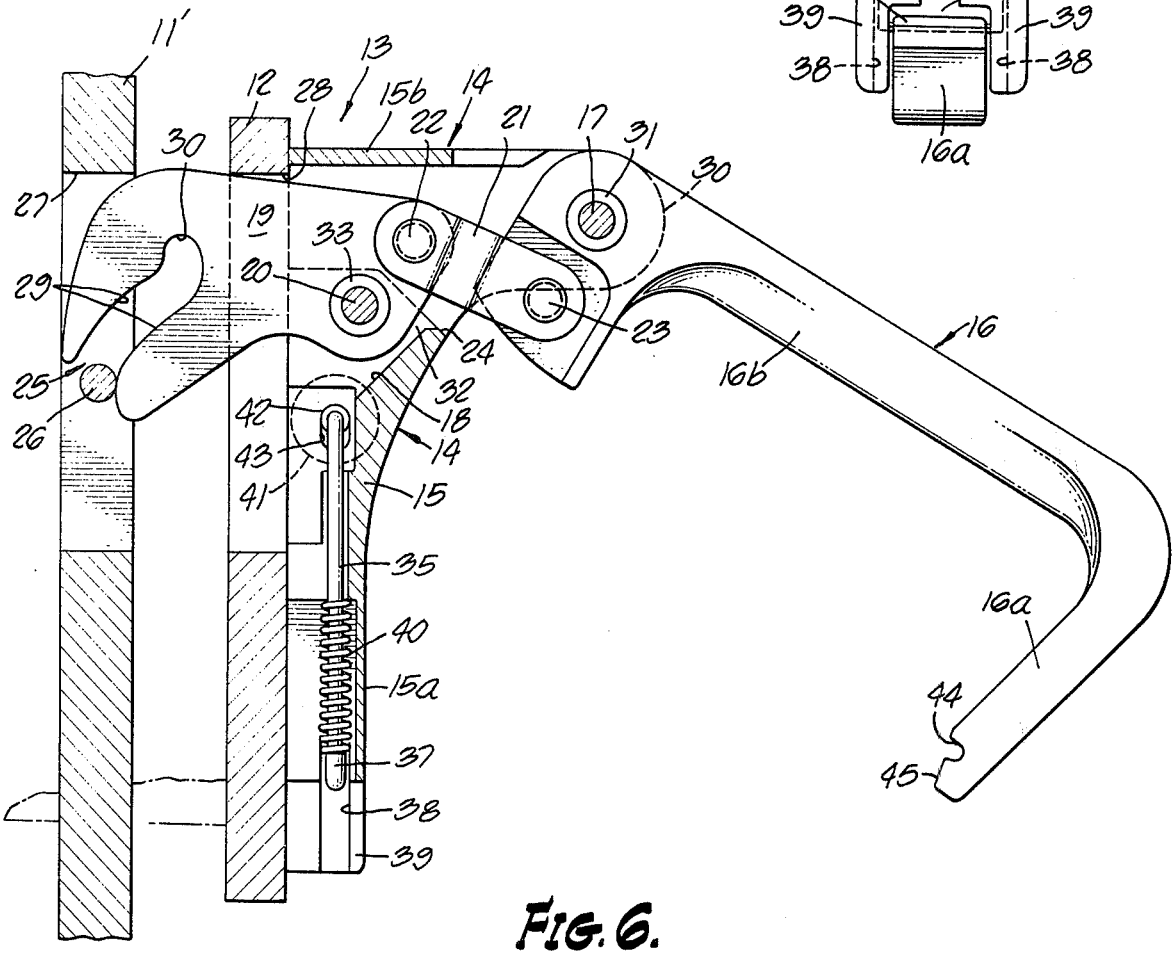
FIG. 6 is a view similar to FIG. 2, except that the parts are shown in unlocked position.

As best shown in FIGS. 2 and 6, each drawer handle assembly 13 comprises a mounting bracket 14 which is secured in an upright position against the forward surface of the front panel 12 by conventional means, not shown. This mounting bracket includes an inverted L-shaped body 15 formed to provide an elongated depending leg portion 15*a* and a right-angled projecting upper leg portion 15*b*. The mounting bracket carries an L-shaped handle member, as generally indicated at 16, this handle member having a rearwardly directed lower leg portion 16*a*, and an elongated upwardly extending leg portion 16*b* conformed to provide a handgrip. The uppermost end of the leg portion 16*b* is pivoted to the outermost end of the leg portion 15*b* by means of a pivot pin 17 to provide for swinging movement of the handle 16 between a position in which the lower leg portion 16*a* engages the leg portion 15*a* of the mounting bracket, as shown in FIG. 2, and an outer inclined position with respect to the bracket, as shown in FIG. 6.

The mounting bracket is of hollow construction and fabricated to provide an internal cavity 18 which is open on the rear face of the bracket. As best shown in FIG. 2, a hook member 19, of substantially flat configuration, is supported at its innermost end within the cavity 18 by means of a pivot 20 for limited swinging movement of its outermost end portion which projects rearwardly of the mounting face of the bracket 14.

The hook 19 is operatively connected to the handle member 16 by a pair of similar link members 21, these links having one set of ends disposed on opposite sides of the inner end of the hook 19, and being pivotally connected thereto by a pivot pin 22. The other set of ends of these links are positioned on opposite sides of a part of the leg portion 16*b* of the handle member, and pivotally connected by a pivot pin 23.

As will be observed in FIG. 2, the pivot pins 22 and 23 connect with arm portions respectively of the hook and handle such that the pins will be spaced from the pivot centers of pivot pin 20 and pivot pin 17 in a radial direction, and lie on radially extending axes which are in substantially right-angled relation, when the handle is in the closed position as shown in FIG. 2. In the open position of the handle 16, as shown in FIG. 6, the radial axes of the pivot pins 22 and 23 will extend in substantially parallel relation. Thus, in the open position of the handle 16, the hook 19 will occupy a raised unlocked position. During movement of the handle to closed position, as shown in FIG. 2, the hook will be swung in a counter-clockwise direction into a locking position, and in this position the pivot pin 23 will have moved through an over-center position with respect to a line connecting the centers of the pivot pins 17 and 22. Thus, the hook 19 will be latched against rotative movement by forces acting thereon and tending to move it in a clockwise direction. As further shown in FIG. 6, during movement of the handle 16 to open position, the pivot pin 23 and the portion of the handle to which it is connected is enabled to move through a forward opening 24 of the cavity 18.

The rear end of the hook 19 is formed with an end opening slot 25 which is adapted, when the hook is moved by means of the handle 16 to the position shown in FIG. 6, to receive through its open end a transversely extending keeper 26, this keeper having a circular cross-section and being recessed within and extending transversely of an opening 27 formed in the adjacent forward wall 11′ of the cabinet. A similar opening 28 in the front panel 12 receives the projecting hook 19 therethrough.

The handle 16 in its open position, as shown in FIG. 6, is utilized for the normal movement of the sliding drawer towards and from its fully opened position. As the drawer approaches a fully closed position, wherein the front panel 12 is slightly spaced from the cabinet side flanges 11′, the continued closing movement of the drawer will cause the keeper 26 to enter the open end of the slot 25. At this point, the handle 16 may then be moved towards the position shown in FIG. 2, whereupon the hook will be swung downwardly and thus cause the keeper 34 to relatively move into the slot where it will engage guiding camming edges 29 which are curved in a manner to produce amplified and increased forces for effecting closing and opening movements of the drawer by virtue of swinging movements of the handle 16. With the handle 16 in the position shown in FIG. 2, the keeper 26 will be positioned at the innermost end of the slot 25, and in this position the hook serves to lock the drawer against opening movement. As will be seen, the innermost end of the slot 25, as indicated by the numeral 30, is angularly deflected so as to provide an increased area of contact between the associated slot edge and the circumferential perimeter of the keeper. This increased contact is of particular advantage in that it permits the keeper to successfully carry the high shock loads which may be applied against it under certain operating conditions.

As a further feature of the handle structure of the present invention, the keeper 26 is so arranged that it will engage a fully seated position in the end 30 of the slot 25 just prior to the passage of the pivot pin 23 through the over-center position. Thus as the handle 16 is moved to fully closed position, as shown in FIG. 2, the action will be such that a load holding force will be applied between the hook and the keeper at the fully closed position of the drawer. During opening movement of the drawer, movement of the handle 16 from fully closed position as shown in FIG. 2 towards an open position as shown in FIG. 6 will move the hook so that the coaction of the keeper and the camming edges will apply increased forces during the initial opening of the drawer from the fully closed position.

As shown in FIG. 3, the projecting upper leg portion **15*b* of the bracket is formed to provide integral spaced lugs 30 which are arranged to straddle the upper end of the handle 16 and provide mountings for the opposite ends of the pivot 17. Preferably spacing washers 31 are positioned on each side of the lever between it and the associated lug. Also, in order to more firmly support the hook 19 in its rotative movement on the pivot 20, it will be seen from FIG. 5 that the bracket is provided with spaced integrally formed facing projections 32 which provide supports for the ends of the pivot pin 20. Preferably, spacer washers 33 are provided on each side of the hook. As further shown in FIG. 5, a plurality of threaded sleeve inserts 34 may be provided on the rear face of the mounting bracket 14 to facilitate its mounting on the front panel 12** of the drawer.

Figure 4:
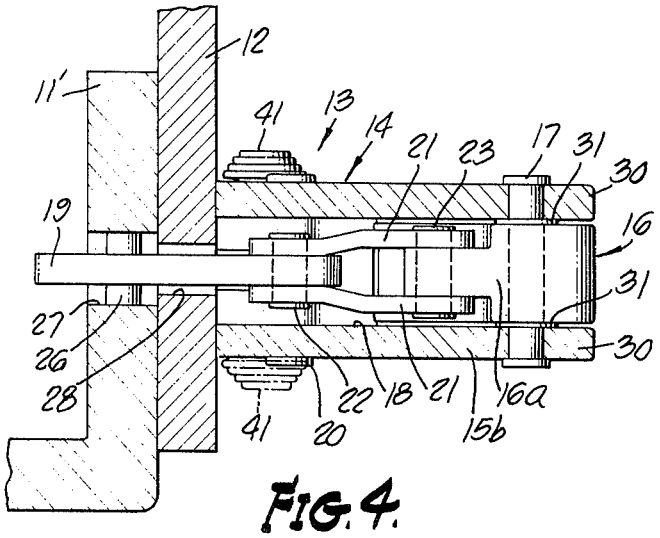
FIG. 4 is a fragmentary horizontal sectional view taken substantially on line 4—4 of FIG. 2.
Figure 5:
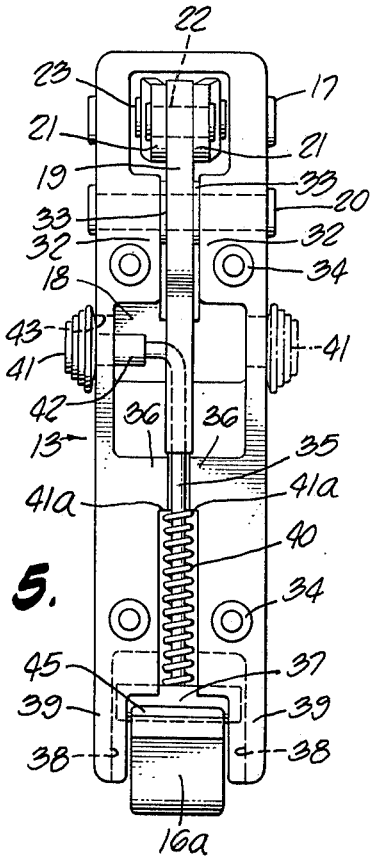
FIG. 5 is a rear elevational view of the handle structure as seen when viewed along line 5—5 of FIG. 2.

As a further feature, a safety latch mechanism is provided for releasably holding the handle 16 in its closed position. As best shown in FIGS. 2 and 5, this latching mechanism comprises an elongated stem 35 which is positioned for vertical reciprocal movements between a pair of spaced guide shoulders 36 at the rear of the bracket. The lowermost end of the stem is fitted with a transversely extending head member 37 which is guidingly supported at its opposite ends in guide grooves 38 which are formed respectively in downwardly projecting spaced apart extensions 39. Below the guide shoulders 36, the space therebetween is widened to receive a coiled compression spring 40 which has its lowermost end bearing against the head member, and its uppermost end bearing against abutment shoulders **41*a*, this spring normally acting to urge the stem and head member in a downward direction. This downward movement is limited by means of a release button 41 on the side of the bracket body, this button having a shank portion 42 which is movable within a vertically extending slot 43 and having its innermost end connected with a right-angled portion of the stem 35. Downward movement of the head 37 is limited by the engagement of the shank 42 with the bottom end of the slot 43 which constitutes a latching position of the head member 37. The head member may be raised from this latching position by manually moving the button so as to raise the shank 42 towards the upper end of the slot 43. As shown in FIG. 5, the button 41** may be mounted on the right or left side of the mounting bracket to adapt the latch to either a right or left drawer handle assembly, as desired.

The outermost end of the handle portion **16*a* is provided with a transversely extending notch 44 which is adapted to receive the head portion, when the handle 16 is moved to the closed position, as shown in FIG. 2. To facilitate movement of the handle to its closed and latching position, the upper surface of the end terminus of the portion 16*a* is provided with an angular ramp 45 which serves to cam the spring urged head upwardly and into a latching position within the notch 44. The handle 16 may be released for movement to open position simply by raising the release button 41 agaist the action of spring 40.**

From the foregoing description and drawings, it will be clearly evident that the delineated objects and features of the invention will be accomplished.

Various modifications may suggest themselves to those skilled in the art without departing from the spirit of our invention, and, hence, we do not wish to be restricted to the specific forms shown or uses mentioned, except to the extent indicated in the appended claims.

We claim:

1. A drawer handle with releasable drawer locking means, comprising:

a. a body structure adapted for surface mounting in an upright position on a front member of a drawer;

b. elongated handle means pivoted at one end on said body structure at a position outwardly spaced from said front member for selective swinging movements of its other end to a position of engagement with said body and to a position outwardly spaced from said body, the lower end of the handle being rearwardly angularly extended towards the body;

c. a hook member pivoted on said body at a position outwardly spaced from said front member for swinging movements between locking and non-locking positions, said hook extending rearwardly through said front member for engagement with a keeper;

d. means operatively connecting said hook with said handle, whereby swinging movements of the handle will be imparted to said hook; and e. spring detent means releasably engageable with said lower end of the handle in said position of engagement with said body.

2. A drawer handle according to claim 1, wherein said connecting means comprises a connecting link such that the hook member will be in a latching position when said other end of the handle is in said position of engagement with said body.

3. A drawer handle according to claim 2, wherein said link member having one end pivotally connected with said handle means and another end pivotally connected with said hook, and in which one of said link pivot connections assumes an over-center position in the fully locked positions of said hook and said handle.

4. A drawer handle according to claim 3, wherein the pivot connections of said link member to said hook and said handle are respectively spaced from the hook and handle pivots on radial axes adapted to assume substantially right angled relation in the locking position of said hook, and substantially parallel relation in the non-locking position of said hook.

5. A drawer handle according to claim 1, wherein said handle means is L-shaped and has its upper end pivoted adjacent the pivot of said hook member at the top of said body structure.

6. A drawer handle according to claim 1, including a digitally movable detent means release button on one side of said body structure.

7. A drawer handle according to claim 1, including releasable detent means engageable with said other end of the handle in said position of engagement with said body, said detent means comprising:

a head member at the lower end of said body supported for guided limited raising and lowering movements;

an upwardly extending stem having a lowermost end secured to said head member;

a coiled spring surrounding said stem, one end of said spring bearing against said head member, and its other end bearing against an abutment on said body whereby said head member is resiliently urged in a downward direction;

a groove at the terminal portion of said other end of said handle for seatingly receiving an edge portion of said head member when the handle is moved to said position of engagement with said body; and a digitally movable member connected with said stem operable to raise said head member against the force of said spring to a disengaged position out of said groove so as to enable movement of said handle to said position outwardly spaced from said body.

8. A drawer handle according to claim 7, wherein said other end of the handle comprises a laterally extended end portion, and includes a camming surface for guiding the edge portion of said head member into said groove when the handle is moved to said position of engagement with said body.

9. A drawer handle according to claim 2, wherein said hook member is of generally flat configuration and formed with an end opening slot adapted in its non-locking position to receive a keeper bar member of circular cross-section for movement therein during movement of said hook member to said locking position, said slot including a camming surface for coacting with the keeper to activate the hook towards a locking position in response to a closing movement of the drawer; and means including said connecting link for releasably retaining the hook against movement from said locking position.

10. A drawer handle according to claim 9, in which the innermost end of said slot is so formed as to provide an increased area of contact of the slot edge circumferentially of the keeper for withstanding high shock load forces which may occur in the fully closed position of the drawer.

11. A drawer handle according to claim 2, wherein the keeper is in the form of a bar having a circular cross-section and being mounted to the front of the cabinet structure, and the hook member embodies an end opening slot for receiving and coacting with said bar to selectively move the drawer to closed and opened position in response to swinging movements of said handle.

12. A drawer handle according to claim 11, in which said handle, connecting link and hook coact to progressively mechanically increase the manually applied forces of engagement of the hook with the keeper to obtain greater final closing and initial opening forces on the drawer.

13. A drawer handle according to claim 11, in which said slot has opposed camming edges of one configuration adjacent its open end for coacting with said keeper bar to apply drawer closing forces of a predetermined magnitude under a constantly applied handle force, and other camming edges of a different configuration adjacent the inner end of said slot to apply drawer closing forces of a greater magnitude under said handle force than that of said predetermined forces.

* * * * *